United States Patent [19]

Santanen

[11] 4,452,434

[45] Jun. 5, 1984

[54] COMBINATION OF A SMELTING-FURNACE POURING LIP AND CASTING GUTTER

[75] Inventor: Onni Santanen, Pori, Finland

[73] Assignee: Outokumpu Oy, Outokumpu, Finland

[21] Appl. No.: 357,208

[22] Filed: Mar. 11, 1982

[30] Foreign Application Priority Data

Mar. 27, 1981 [FI] Finland ..... 810958

[51] Int. Cl.[3] ..... C21C 5/52

[52] U.S. Cl. ..... 266/159; 75/46; 266/236; 432/156

[58] Field of Search ..... 266/44, 236, 158, 159, 266/230, 231, 238, 239, 240, 207, 195, 196; 164/336, 337; 75/46; 222/590, 591, 603, 604, 606; 432/156

[56] References Cited

U.S. PATENT DOCUMENTS

| | | | |
|---|---|---|---|
| 16,690 | 2/1857 | Martien | 266/196 |
| 2,252,760 | 8/1941 | Duclos | 266/196 |
| 2,329,049 | 9/1943 | Hulme | 266/240 |

FOREIGN PATENT DOCUMENTS

| | | | |
|---|---|---|---|
| 319828 | 12/1971 | U.S.S.R. . | |
| 368330 | 3/1973 | U.S.S.R. | 266/159 |
| 390343 | 10/1973 | U.S.S.R. | 432/156 |
| 289748 | 10/1977 | U.S.S.R. | 266/236 |
| 743783 | 7/1980 | U.S.S.R. | 222/603 |

*Primary Examiner*—L. Dewayne Rutledge
*Assistant Examiner*—S. Kastler
*Attorney, Agent, or Firm*—Klarquist, Sparkman, Campbell, Leigh & Whinston

[57] ABSTRACT

A combination of a smelting-furnace pouring lip and casting gutter, in which the pouring lip and the casting gutter form a substantially closed system from which a discharge system arranged in connection with the smelting-furnace draws the metal vapors and flue gases through the casting pipe substantially completely.

7 Claims, 5 Drawing Figures

COMBINATION OF A SMELTING-FURNACE POURING LIP AND CASTING GUTTER

BACKGROUND OF THE INVENTION

1. Field of the Invention

The present invention relates to a combination of a smelting-furnace pouring lip and casting gutter, which is intended for use especially in connection with smelting-furnaces which have mechanism for removing metal vapors and/or flue gases.

2. Description of the Prior Art

It is known to make arrangements for the removal of metal vapors and/or flue gases from a certain point by means of various suction fan or blower systems. One such system is disclosed in U.K. application print No. 2,001,164, which discloses a device for removing vapors from a smelting-furnace in such a way that the device automatically turns to a position in which it captures also the gases discharging from the pouring lip during the pouring. However, the device in no way takes into consideration the fact that deleterious gaseous substances are also removed from the casting gutter. Furthermore, the technical application of the device is very complicated with many tipping shafts and lever systems.

SUMMARY OF THE INVENTION

The object of the present invention is to provide a system, more complete than the known systems, for removing flue gases and metal vapors not only from the smelting-furnace itself but also from the pouring lip and the casting gutter. A further object of the invention is to achieve maximum removal by means of a very simple and operationally reliable apparatus.

BRIEF DESCRIPTION OF THE DRAWINGS

The invention is described below in greater detail with reference to the accompanying drawings, in which.

DESCRIPTION OF THE PREFERRED EMBODIMENTS

Figure 1:
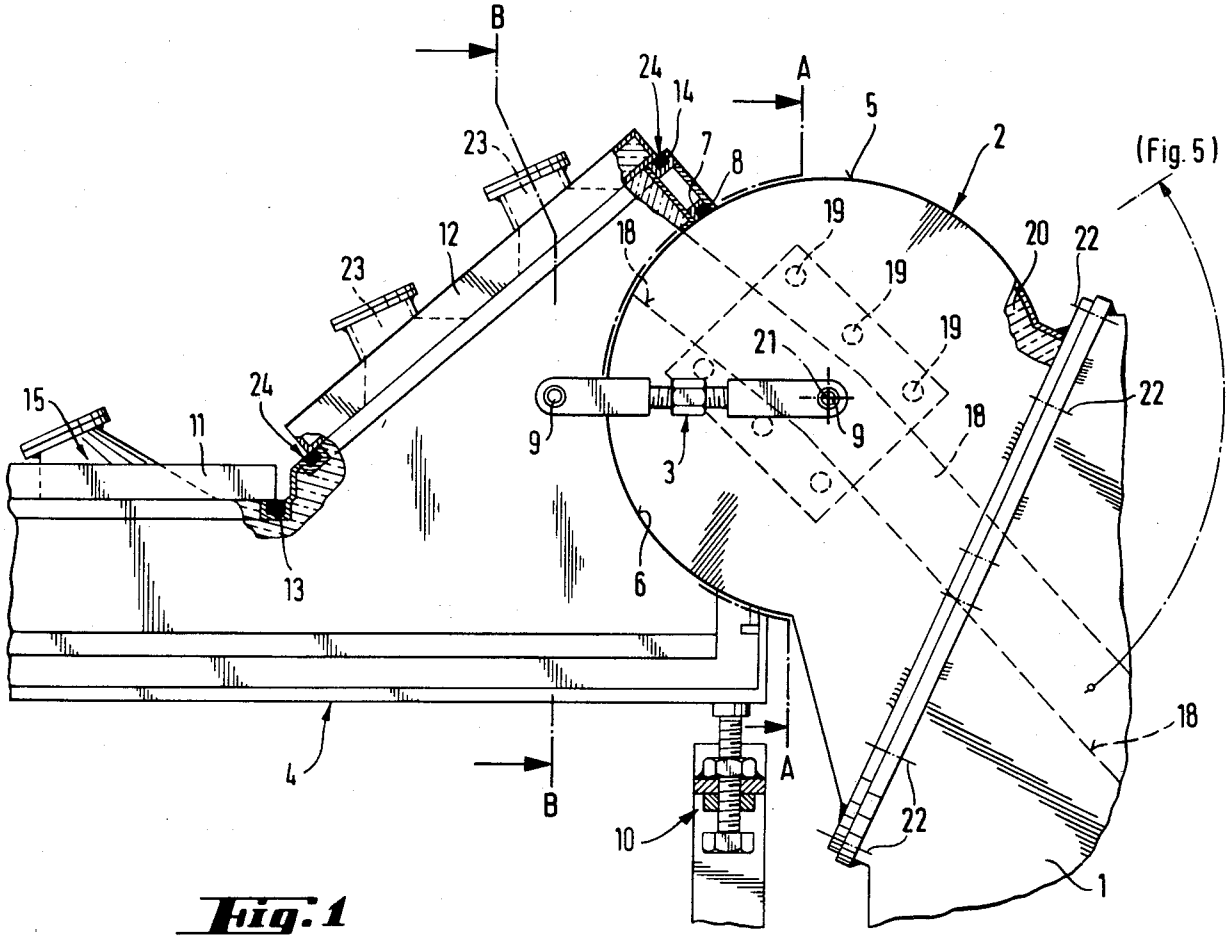
FIG. 1 depicts a side elevation of the combination according to the invention.
Figure 2:
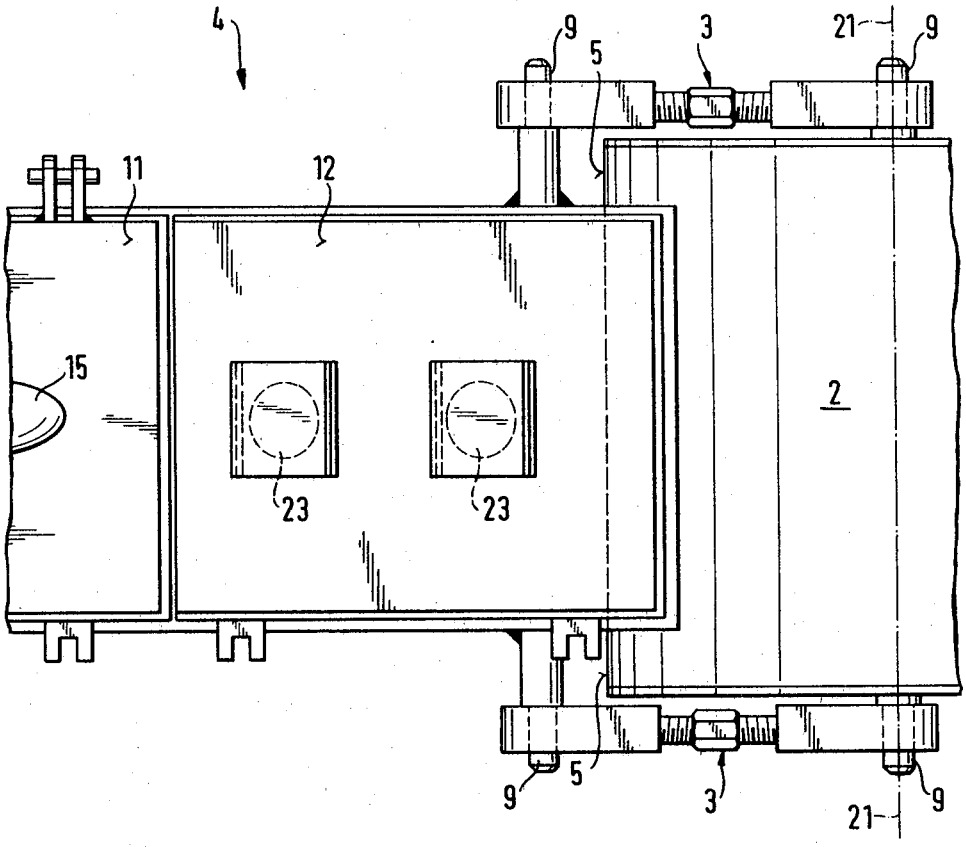
FIG. 2 depicts a plan view of the combination according to the invention.
Figure 3:
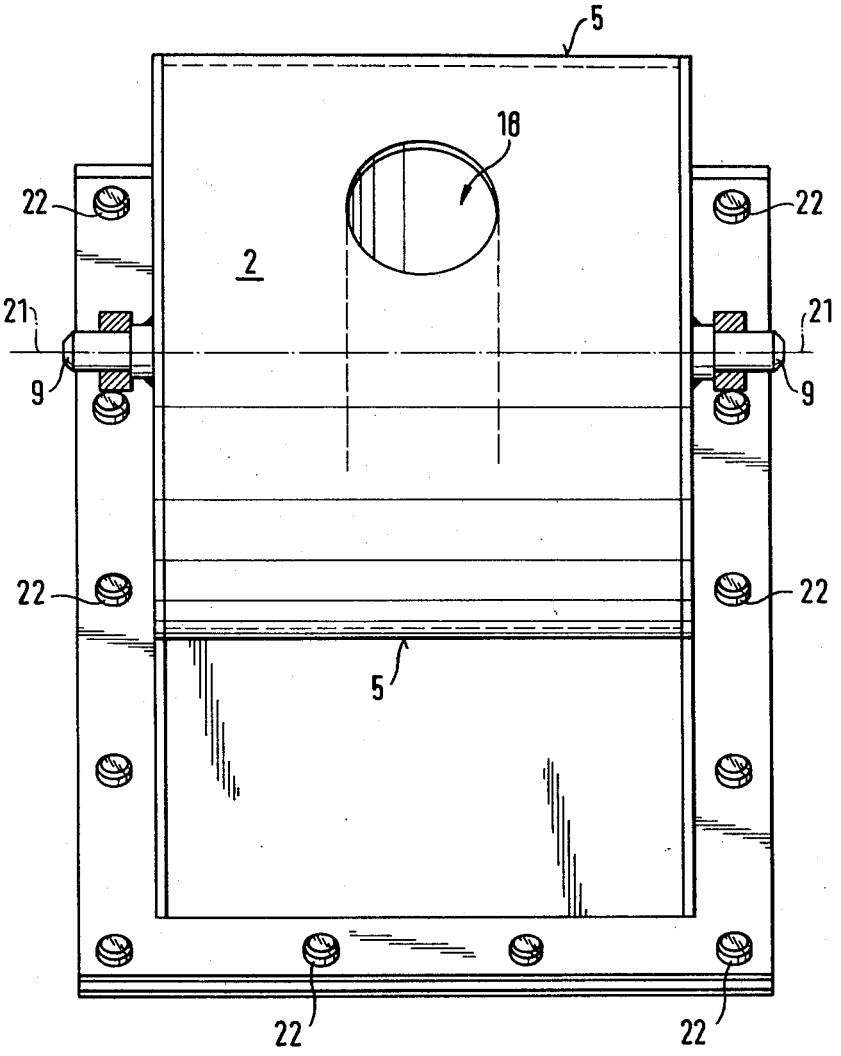
FIG. 3 depicts the combination according to the invention at section A—A indicated in FIG. 1.

The combination according to the invention consists of a pouring lip 2 and a casting gutter 4 tightly attached to each other. In order that the seal be as good as possible, the pouring lip has a convex cylindrical surface 5 mating with the casting gutter, and the casting gutter for its part has a corresponding concave cylindrical surface 6. Thus the tipping of the pouring lip to the casting position via the tipping shaft 21 does not change the precise mating of the cylindrical surfaces. The casting gutter is provided with a sealing groove 7 in which there is a seal 8 resistant to high temperatures.

The rigging screw 3, which is placed on the swivel pins 9 in the pouring lip 2 and the casting gutter 4, and the screw 10 help in centering the seal and in guiding it to the optimum position. The purpose of the screw 10 is, furthermore, to raise the casting gutter somewhat at that end which has the pouring lip 2, whereby the flow of the melt in the gutter 4 is ensured. The pouring lip is demountably attached to the furnace 1, for example by means of a bolt joint 22.

The casting gutter 4 has two separate covers 11 and 12, which are both demountable. They are also both sealed to the body of the gutter 4 by means of sealing grooves 13 and 14 holding seals 24, which are resistant to high temperatures. Furthermore, all the seals of the combination are, if so desired, placed in seal sleeves in order to pack the flexible sealing material. The cover 11 is provided with an opening 15 in which a burner is installed, when so desired, to preheat the casting gutter in order that the metal being cast remain sufficiently molten all the time and not adhere to the gutter. The cover 12 is provided with openings 23, the intention being to install in them systems for blowing shield gas into the casting gutter 4. If a burner and devices for blowing shield gas are not connected to openings 15 and 23, the openings are closed tightly with separate covers.

Figure 4:
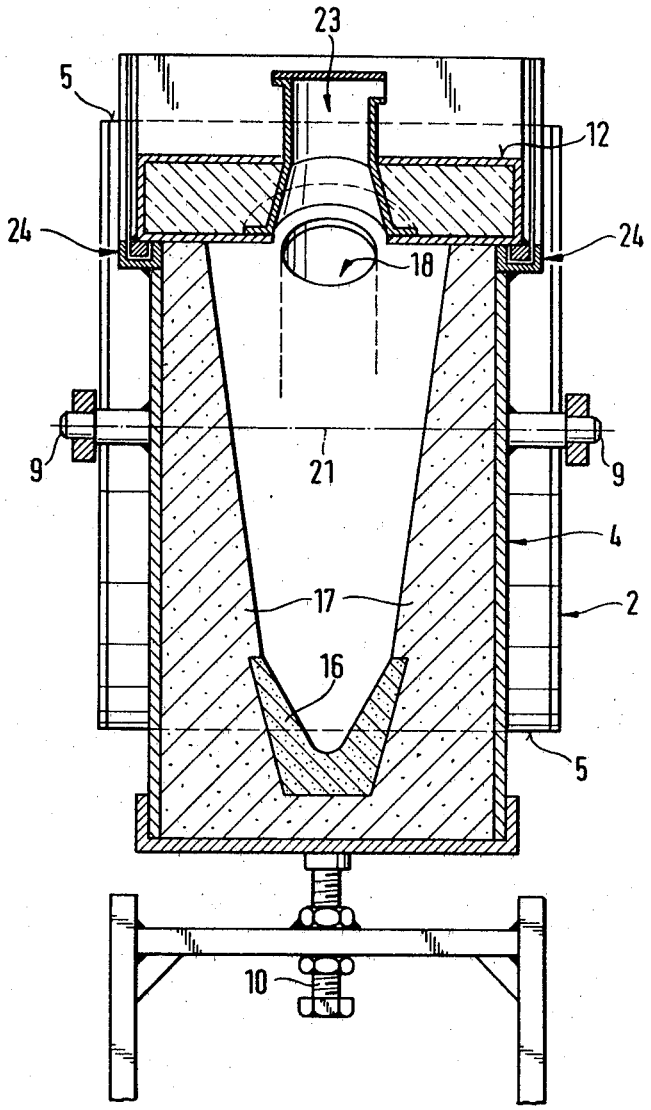
FIG. 4 depicts the combination according to the invention at section B—B indicated in FIG. 1.

Especially in FIG. 4 it can be seen that the casting gutter 4 is lined with insulation material 17, in addition to which the bottom of the gutter has a brick lining 16. The covers 11 and 12 are also insulated in order to minimize heat losses. For the same purpose, an insulation layer 20 has also been provided in the pouring lip 2. In order to minimize the adhering of the melt to the casting pipe 18, the casting pipe is also preheated by heating resistors 19 placed around it.

The manufacture of the parts of the combination according to the invention is ordinary machine shop production, their manufacture involves no complicated phases which require precision work. In addition, the combination according to the invention requires only one tipping shaft 21 and very few other parts, and so the combination according to the invention is very economical in terms of both manufacture and operation.

The maintenance and cleaning of the combination according to the invention, as well as any replacement of parts, are very easy. Since the covers 11 and 12 of the casting gutter 4 can be demounted when necessary, it is extremely easy to carry out cleaning and repairs from above. Since the casting pipe 18 is provided with resistors 19 in order to maintain it hot for a sufficiently long time for all the metal to flow out of the casting pipe, there is hardly any need to clean it, even if different metals are cast successively through it. The pouring lip itself is also easy to replace, since it is attached to the furnace 1 by means of bolts and to the casting gutter 4 only by means of rigging screws 3.

Figure 5:
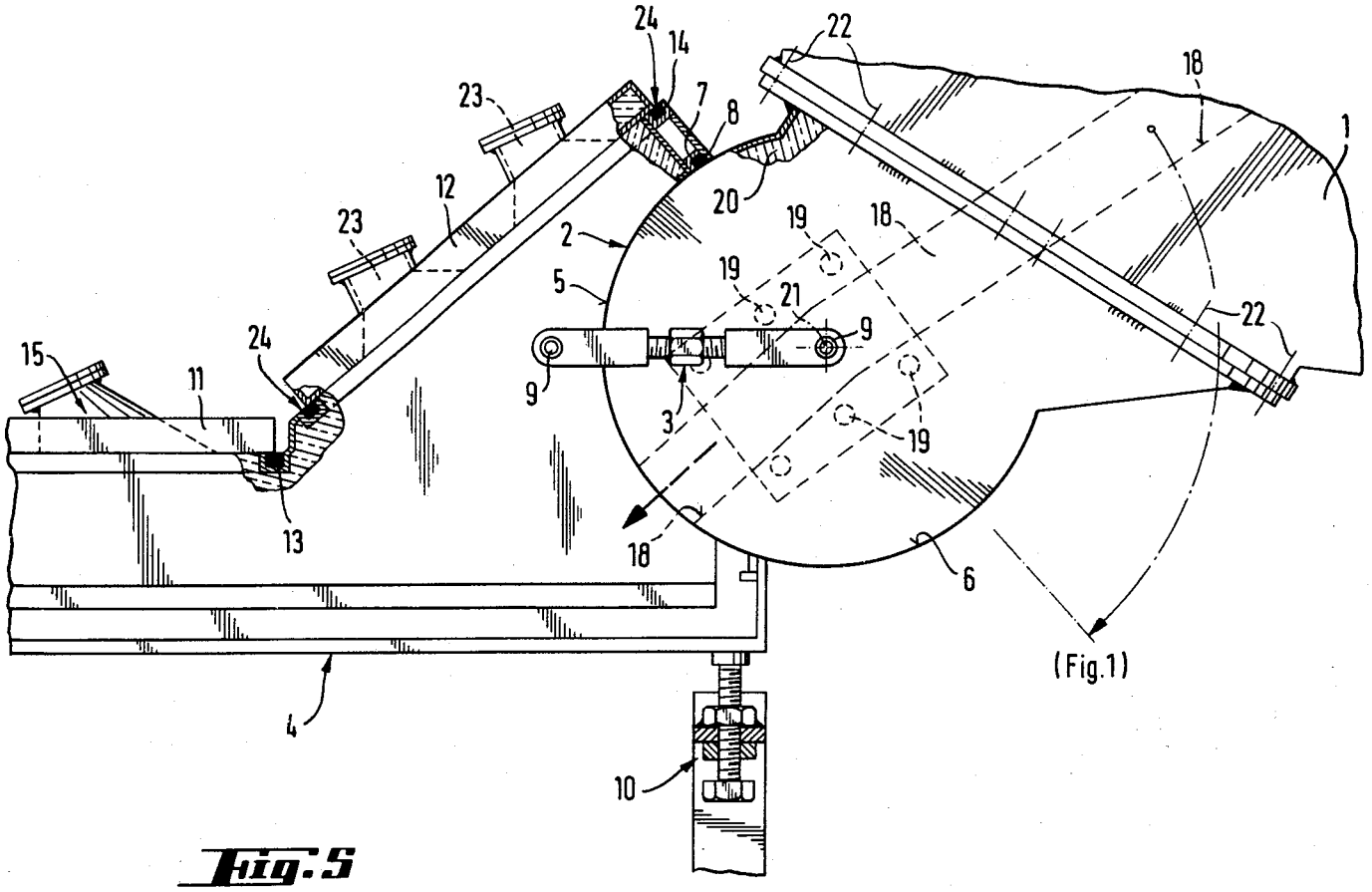
FIG. 5 depicts the combination according to the invention in the casting position.

The combination operates as follows: When the casting begins, the furnace 1 with its pouring lip 2 is tilted very slowly about the tipping shaft 21 from the position shown in FIG. 1 to the position shown in FIG. 5. Simultaneously an inert gas atmosphere is blown into the casting gutter 4 by means of suitable devices installed in the openings 23. A suction fan (not shown) is connected to the smelting-furnace 1, and the suction fan produces a reduced pressure in the furnace 1 and, through the casting pipe 18, also in the casting gutter. After the casting, the movement of the pouring lip is reversed, and after no more melt flows out of the furnace the casting gutter and the casting pipe are cleaned automatically as even the last of the melt flows out of them into the object being cast.

What is claimed is:

1. A combination of a smelting-furnace pouring lip and casting gutter, which is intended to ensure maximum removal of deleterious gaseous substances from a smelting and casting system including a smelting-furnace, the combination comprising:

an enclosed casting gutter;

a pouring lip affixed to the smelting-furnace and including means defining a conduit providing continuous communication between the furnace and casting gutter;

joint means hingedly connecting the pouring lip to the casting gutter so that the furnace and pouring lip can be tipped as a unit about the casting gutter to pour melt from the furnace through the conduit into the casting gutter;

sealing means including complementary sealed joint surfaces for interfacing the pouring lip and casting gutter so that the pouring lip can tip about the casting gutter in such a manner that sealing contact between the joint surfaces is maintained, in order to form a system which is substantially closed but opens into the smelting-furnace via the conduit;

means for admitting shield gas into the casting gutter;

means for inducing a flow of gases and vapors, including the shield gas, from the casting gutter through the conduit and into the furnace; and means in the smelter-furnace for discharging said gases and vapors from the furnace and thereby substantially removing said deleterious gaseous substances from the entire system through the furnace.

2. A combination according to claim 1, wherein the joint surfaces are made up of a convex surface received in a concave surface in the casting gutter, the cross section of which is at each point part of a circle.

3. A combination according to claim 1, wherein the combination is provided with rigging screws and a lifting screw in order to bring the joint surfaces into a suitable position in relation to each other.

4. A combination according to claim 1, wherein the casting gutter and the pouring lip are thermally insulated.

5. A combination according to claim 1 wherein the casting gutter includes means enclosing an outlet end of said conduit but spaced therefrom to define a passageway into the casting gutter which is in constant communication with the conduit.

6. A method for removing deleterious gaseous substances from a smelting and casting system including a smelting-furnace and an enclosed casting gutter, comprising:

providing a pouring lip on the smelting-furnace;

hingedly connecting the pouring lip to the casting gutter for tipping the furnace and pouring lip as a unit about the casting gutter between a non-pouring position and a pouring position to pour melt into the casting gutter;

providing a conduit within the pouring lip having an inlet end in the furnace and an outlet end proximate the casting gutter;

enclosing and sealing the interconnection between the pouring lip and casting gutter around the outlet end of the conduit so as to form an enclosed passageway which is continuously open in both of said positions for gases and vapors to flow between the casting gutter and the furnace;

admitting shield gas into the casting gutter; and continuously discharging gases from the furnace;

thereby establishing a continuous flow of gases and vapors through said passageway from the casting gutter into the furnace to be removed therefrom.

7. A method according to claim 6 including heating the casting gutter and conduit to maintain fluidity of any melt remaining therein when the furnace and pouring lip are in the non-pouring position.

* * * * *